US009980521B2

(12) United States Patent
Buehler et al.

(10) Patent No.: US 9,980,521 B2
(45) Date of Patent: May 29, 2018

(54) AEROSOL-GENERATING SYSTEM WITH IMPROVED PIERCING MEMBER

(71) Applicant: Philip Morris Products S.A., Neuchatel (CH)

(72) Inventors: Frederic Buehler, Neuchatel (CH); Eric Force, Bevaix (CH)

(73) Assignee: Philip Morris Products S.A., Neuchatel (CH)

( * ) Notice: Subject to any disclaimer, the term of this patent is extended or adjusted under 35 U.S.C. 154(b) by 0 days. days.

(21) Appl. No.: 15/321,802

(22) PCT Filed: Jun. 26, 2015

(86) PCT No.: PCT/EP2015/064616
§ 371 (c)(1),
(2) Date: Dec. 23, 2016

(87) PCT Pub. No.: WO2015/197863
PCT Pub. Date: Dec. 30, 2015

(65) Prior Publication Data

US 2017/0143039 A1 May 25, 2017

(30) Foreign Application Priority Data

Jun. 27, 2014 (EP) ..... 14174859

(51) Int. Cl.
*A24F 47/00* (2006.01)
*A24B 15/16* (2006.01)
*B65D 53/00* (2006.01)

(52) U.S. Cl.
CPC ..... *A24F 47/008* (2013.01); *A24B 15/167* (2016.11); *B65D 53/00* (2013.01)

(58) Field of Classification Search
CPC .... A24F 47/002; A24F 47/003; A24F 47/004; A24F 47/005; A24F 47/006; A24F 47/007; A24F 47/008
(Continued)

(56) References Cited

U.S. PATENT DOCUMENTS 3,365,102 A 1/1968 Castleberry
2010/0059070 A1* 3/2010 Potter ..... A24F 47/004 131/194

(Continued)

FOREIGN PATENT DOCUMENTS

WO WO 2008/121610 A1 10/2008
WO 2013/064247 A1 5/2013
WO 2013/128176 A1 9/2013

OTHER PUBLICATIONS

International Search Report and Written Opinion dated Oct. 2, 2015 in PCT/EP2015/064616 filed Jun. 26, 2015.

*Primary Examiner* — Abdullah Riyami
*Assistant Examiner* — Nader Alhawamdeh
(74) *Attorney, Agent, or Firm* — Oblon, McClelland, Maier & Neustadt, L.L.P.

(57) ABSTRACT

An aerosol-generating system is provided, including an aerosol-generating device in cooperation with an aerosol-generating article. The aerosol-generating article includes at least one container housing a nicotine source and at least two seals sealing the at least one container, wherein each seal includes a deformable material. The aerosol-generating device includes an outer housing configured to receive the aerosol-generating article and an elongate piercing member configured to pierce the at least two seals. The elongate piercing member includes a piercing head at a distal end of the elongate piercing member and a hollow shaft portion including at least two apertures. At least one aperture of the at least two apertures is in fluid communication with the at (Continued)

least one container when the aerosol-generating article is received in the aerosol-generating device.

15 Claims, 1 Drawing Sheet

(58) Field of Classification Search
USPC ..... 131/329
See application file for complete search history.

(56) References Cited

U.S. PATENT DOCUMENTS

| | | | | |
|---|---|---|---|---|
| 2014/0261494 | A1* | 9/2014 | Scatterday | A24F 47/008 131/329 |
| 2014/0283854 | A1 | 9/2014 | Magne | |
| 2016/0021932 | A1* | 1/2016 | Silvestrini | A24F 47/004 131/329 |
| 2016/0022930 | A1* | 1/2016 | Greim | A61M 11/042 131/328 |
| 2016/0029694 | A1* | 2/2016 | Clements | A24F 47/004 131/329 |
| 2016/0128384 | A1* | 5/2016 | Luciani | A24F 47/008 131/329 |
| 2017/0340014 | A1* | 11/2017 | Batista | F22B 1/284 |

* cited by examiner

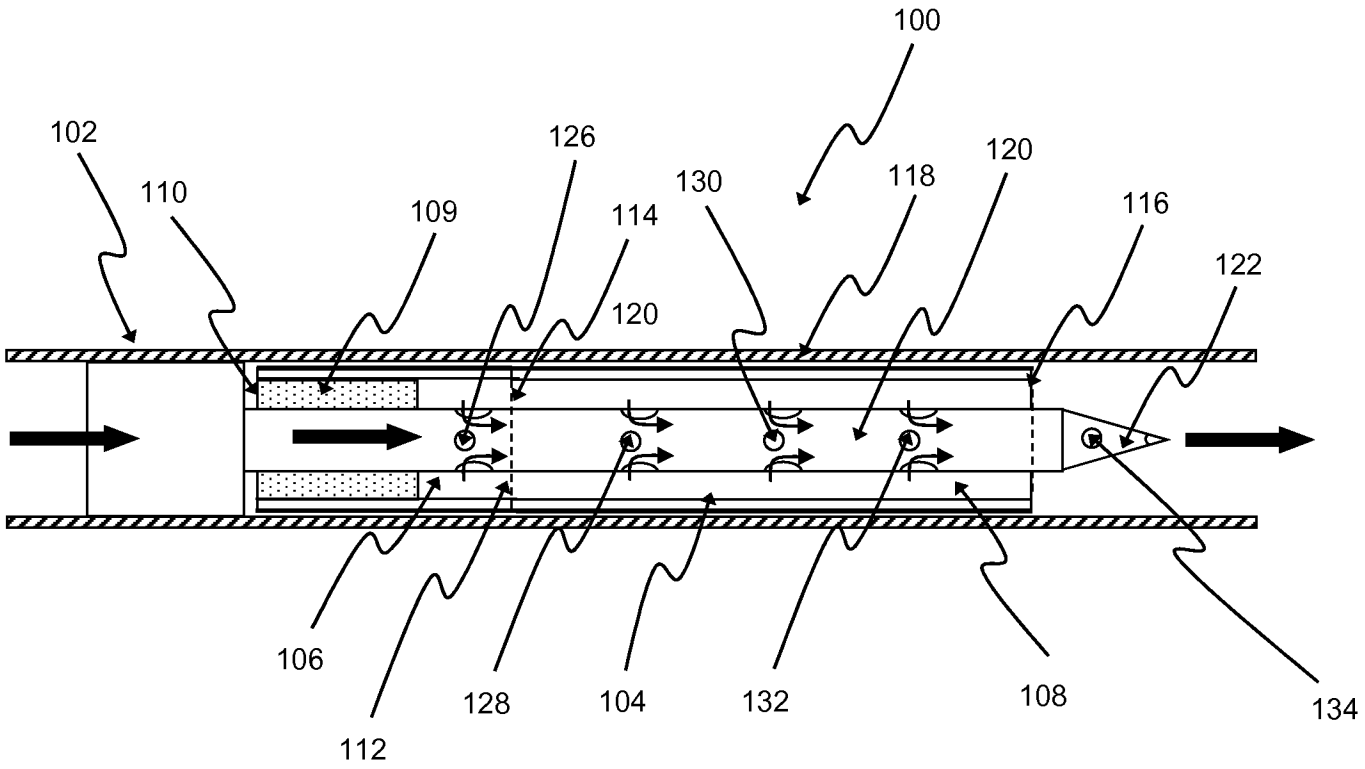
100
102
110
109
126
114
120
130
118
120
116
122
134
108
132
104
128
112
106

AEROSOL-GENERATING SYSTEM WITH IMPROVED PIERCING MEMBER

The present invention relates to an aerosol-generating system for delivering an aerosol to a user comprising an aerosol-generating device and an aerosol-generating article, and in particular to such a system for delivering nicotine to a user.

Aerosol-generating systems comprising one or more reusable parts and a consumable cartridge are known in the art and include commercially sold electronic cigarettes or e-vapour products. Such systems may provide a nicotine or flavour-containing aerosol by vaporising an aerosol-generating liquid. Disadvantages of commercial products may include, for example, liquid leakage, ageing of the liquid or variance in airflow resulting in poor aerosol quality.

It would be desirable to provide improved aerosol-generating systems which avoid one or more of these disadvantages. For example, it would be desirable to store the aerosol-generating liquid without degradation to deliver a high quality aerosol to the user. It would also be desirable to provide an aerosol-generating system for delivering nicotine or flavour to a user in which the nicotine or flavour is released only upon use of the aerosol-generating system. It is an object of the present invention to provide an improved aerosol-generating system which avoids or reduces the disadvantages of the known systems.

The present invention provides an aerosol-generating system comprising an aerosol-generating device in cooperation with an aerosol-generating article. The aerosol-generating article comprises at least one sealed container comprising a nicotine source, wherein the seals sealing the container comprise a deformable material. The aerosol-generating device comprises an outer housing adapted to receive the aerosol-generating article and an elongate piercing member for piercing the seals sealing the at least one container. The elongate piercing member comprises a piercing head, that is a portion at a distal end of the elongate piercing member, and a hollow shaft portion configured to provide an airflow channel through the at least one container. The hollow shaft portion comprises at least two apertures such that, in use, when the aerosol-generating article is received in the aerosol-generating device and the piercing member pierces the seals sealing the at least one container, at least one aperture is in fluid communication with the at least one container.

The elongate piercing member in aerosol-generating systems according to the invention has dual functionality: piercing and providing an airflow channel. Therefore, the aerosol-generating system of the invention provides the benefits of facilitating cost-effective high volume manufacturing. Providing a piercing member comprising a hollow shaft portion and at least two apertures enables airflow through the aerosol-generating system to proceed through the at least one container via the hollow shaft portion of the piercing member. Additionally, using a deformable material to form the seals sealing the at least one container allows the seals to form at least a partial seal around the hollow shaft portion after the piercing member has pierced the seals. Advantageously, this restricts or preferably eliminates airflow around the outside of the piercing member and maximises the airflow through the hollow shaft portion, therefore facilitating the delivery of a consistent aerosol to the user. In particular, forming at least a partial seal around the hollow shaft portion ensures that most, if not all, of the aerosol that exits the at least one container exits through the hollow shaft portion via the at least one aperture in fluid communication with the at least one container.

The elongate piercing member comprises a proximal end attached to the aerosol-generating device and a distal end distal from the proximal end. The distal end comprises the piercing head and is arranged to pierce the seals sealing the at least one container when the aerosol-generating article is inserted into the aerosol-generating device. To facilitate piercing of the seals the distal end of the piercing head preferably comprises a cross-sectional area that is smaller than the cross-sectional area of the hollow shaft portion. In a particularly preferred embodiment, the cross-sectional area of the piercing head narrows from the cross-sectional area of the hollow shaft portion to a point at the distal end of the piercing head. In some embodiments the elongate piercing member has a substantially circular cross-sectional profile and the piercing head has a substantially conical shape.

As used herein with reference to the present invention, the term "aerosol-generating system" refers to the combination of an aerosol-generating article as further described and illustrated herein with an aerosol-generating device as further described and illustrated herein. In the system, the article and the device cooperate to generate a respirable aerosol comprising nicotine. Preferably, the aerosol-generating system according to the invention is a pulmonary delivery system and the aerosol comprising the nicotine can be delivered to the user's lungs.

As used herein with reference to the present invention, the term "aerosol-generating device" refers to a device that interacts with an aerosol-generating article to generate an aerosol comprising nicotine that is directly inhalable into a user's lungs thorough the user's mouth. The aerosol-generative device includes the elongate piercing element and preferably further comprises a power source to heat at least one heater assembly for heating the aerosol-generating article, and in particular for heating the nicotine source. The at least one heater assembly may be provided in the aerosol-generating device or the aerosol-generating article.

As used herein with reference to the present invention, the term "aerosol-generating article" refers to an article comprising at least one sealed container housing a nicotine source and capable of releasing volatile compounds, which can form an aerosol comprising nicotine at ambient temperature or upon heating. In some embodiments, the aerosol-generating article comprises a single container housing the nicotine source and comprises a seal at each end of the container. In other embodiments, the aerosol-generating article comprises two or more sealed containers, wherein each container comprises a seal formed from a deformable material at each end of the container. In such embodiments, at least one of the containers houses a nicotine source. The other containers may also house a nicotine source, or they may house one or more other substances, such as a volatile delivery enhancing compound or one or more flavourants. In those embodiments comprising two or more containers, the containers are arranged sequentially within the aerosol-generating article so that the elongate piercing member pierces all of the seals on all of the containers when the aerosol-generating article is inserted into the aerosol-generating device. The two or more containers may be arranged within the aerosol-generating article so that the containers abut each other, or the containers may be spaced apart.

As used herein, the term "deformable material" refers to a material that undergoes a plastic or elastic deformation upon the application of a force to the material and at the same time can be pierced by the elongate piercing member upon application of a moderate force to insert the aerosol-generating article into the aerosol-generating device. Advantageously, after being pierced, the deformable material can form at least a partial seal around the hollow shaft portion of the elongate piercing member. In contrast to a deformable material suitable for use in forming seals in the present invention, brittle materials are rigid and will tear, crack or shatter upon the application of a force to the material.

The deformable material preferably has a Young's modulus of less than about 10 GPa, more preferably less than about 8 GPa, most preferably less than about 5 GPa. Additionally, or alternatively, the deformable material preferably has a Young's modulus of at least about 0.01 GPa, more preferably at least about 0.1 GPa, most preferably at least about 1 GPa. The deformable material may have a Young's modulus of between about 0.01 and about 10 GPa, preferably between about 0.1 and about 8 GPa, most preferably between about 1 and about 5 GPa. Materials having a Young's modulus within these ranges exhibit a high degree of elasticity, particularly at the relatively low strains typically encountered when piercing a seal on an aerosol-generating article, or a container of the article. Therefore, deformable materials having a Young's modulus within these ranges provide optimum resealing of the seal around the hollow shaft portion of the piercing member after the piercing head has pierced the seal. At the same time, deformable materials having a Young's modulus within these ranges exhibit sufficient rigidity to enable the piercing head of the elongate piercing member to pierce the seal. If a seal is formed using a material having a Young's modulus value that is too low, the material may be too elastic for use in the present invention such that upon the application of force by the piercing member the seal will deform without piercing.

Unless otherwise specified, values of Young's modulus expressed herein are measured in accordance with ASTM E111-04.

Suitable deformable materials for forming the seals include polymeric materials, such as rubber and plastics. For example, suitable deformable materials include natural rubber, synthetic rubber, polyethylene, polypropylene, polychloro-tri-fluoro-ethylene, fluorinated ethylene propylene, acrylonitrile-methyl acrylate copolymers, and mixtures of these materials. The deformable material may also be formed as a laminate of one or more layers of these materials.

For ease of manufacture, the seals are preferably formed as stoppers each comprising an end face and a flange extending from the end face around the perimeter of the end face. In this case, each container preferably comprises a tubular portion housing the nicotine source or other volatile compound source and a stopper inserted at each end of the tubular portion. The flange on each stopper provides a sealing interference fit with the internal surface of the tubular portion. During insertion of the aerosol-generating article into the aerosol-generating device, the elongate piercing member pierces the end face of each stopper, therefore breaking the seal. Advantageously, seals in the form of stoppers can be manufactured using cost-effective high volume manufacturing processes and they simplify the construction of the containers.

Preferably, the seals sealing each container provide a hermetic seal. The term "hermetic seal" is used to refer to a sealed container wherein the oven volatiles content of the container does not change by more than about 4 percent by weight of the total contents of the container during a 2 week period in which the seal remains intact. Preferably, the oven volatiles content of the container does not change by more than about 2 percent by weight of the total contents of the container during the 2 week period. The term "oven volatiles" refers to the volatile contents of the container, and the total weight of the oven volatiles within a container can be measured as the reduction in mass when the contents of the container are dried in a forced draft oven at a temperature regulated to 100 degrees Celsius for three hours.

To facilitate complete resealing of the deformable material around the hollow shaft portion of the piercing member, the maximum diameter of the piercing head is preferably less than or equal to the maximum diameter of the hollow shaft portion. This arrangement ensures that the piercing head does not form an aperture in the seal that is larger than the maximum diameter of the hollow shaft portion. Therefore, minimal or no contraction of the deformable material is required to reseal the seal around the hollow shaft portion of the piercing member after the seals have been pierced and the aerosol-generating article has been fully inserted into the aerosol generating device. Furthermore, providing a piercing head having a maximum diameter that is less than or equal to the maximum diameter of the hollow shaft portion facilitates the manufacture of the entire piercing member as a single piece.

The hollow shaft portion and the piercing head preferably have a maximum diameter of between about 1 mm and about 3 mm, more preferably between about 1.5 mm and about 2.5 mm. In a preferred embodiment the maximum diameter is about 2 mm.

In some embodiments, the hollow shaft portion of the piercing member comprises a tubular portion and the at least two apertures comprise at least two apertures provided in the tubular portion. A tubular portion can be formed without any apertures and the apertures can be machined into the tubular portion in a subsequent manufacturing process, such as punching, drilling, milling or laser cutting. Alternatively, the apertures can be formed integrally at the time of forming the tubular portion. For example, the tubular portion can be moulded or cast to include the apertures.

In alternative embodiments, the hollow shaft portion of the piercing member can be formed from a material that includes two or more apertures without the need to provide a dedicated forming process for forming the apertures. For example, the hollow shaft portion can be formed as a braided tube, wherein the gaps between overlapping braids provide a natural porosity to the braided tube so that the gaps form a plurality of apertures in the hollow shaft portion. Forming the hollow shaft portion from a braided tube therefore eliminates the need to provide a separate process for forming apertures in the hollow shaft portion. Preferably, the braided tube is formed from about 3 or more individual braids. Additionally, or alternatively, the braided tube is formed from less than about 13 individual braids. Most preferably, the braided tube is formed from between about 3 and about 5 individual braids.

Suitable materials for forming the elongate piercing member include metals and metal alloys, such as aluminium, steel, bronze, iron and brass. Alternatively, the elongate piercing member may be formed from a composite material, such as carbon-fibre reinforced epoxy resin, glass fibre composites, and aramid composites. Other suitable materials include hard plastics, such as high density polyethylene and ultra high density polyethylene.

To provide a directed and consistent airflow through the aerosol-generating system, the aerosol-generating system preferably comprises at least one air inlet and at least one air outlet, wherein when the aerosol-generating article is received in the aerosol-generating device, the at least one air inlet is upstream of the at least one container and the at least one air outlet is downstream of the at least one container. In such embodiments, the at least one air inlet and the at least one air outlet are therefore arranged to define an air flow pathway extending from the at least one air inlet to the at least one air outlet via the hollow shaft portion through the at least one container. This optimises the airflow through the at least one container and therefore allows optimum delivery of the nicotine-containing aerosol to the user.

As used herein, the term "air inlet" is used to describe one or more apertures through which air may be drawn into the aerosol-generating system.

As used herein, the term "air outlet" is used to describe one or more apertures through which air may be drawn out of the aerosol-generating system.

To facilitate delivery of the nicotine, the aerosol-generating article optionally comprises at least one additional container comprising a source of a volatile delivery enhancing compound. In such embodiments, the nicotine and the volatile delivery enhancing compound preferably form vapours that react with each other within the aerosol-generating system to form a nicotine salt containing aerosol that is delivered to the user. Suitable volatile delivery enhancing compounds are known in the art and include those described in WO 2008/121610.

To prevent premature reaction of the nicotine with the volatile delivery enhancing compound, the nicotine source and the delivery enhancing compound source are stored separately within the aerosol generating article. Therefore, in some embodiments the at least one container comprises a first container housing the nicotine source and a second container housing a volatile delivery enhancing compound source. The at least two seals comprise first and second seals sealing the first container and third and fourth seals sealing the second container, wherein the seals are formed from a deformable material. The second container containing the volatile delivery enhancing compound source may be positioned upstream or downstream of the first container containing the nicotine source.

In some embodiments, the aerosol-generating article comprises a container housing a flavourant source. The container housing a flavourant source may be instead of a second container containing a volatile delivery enhancing compound source, or the container housing a flavourant source may be a third container in addition to the second container containing the volatile delivery enhancing compound source. Suitable flavourants are known in the art.

In alternative embodiments, the aerosol-generating article may comprise two or more containers, wherein at least one container contains a nicotine source and the other containers contain at least one of a nicotine source and a flavourant source. By providing a range of different articles each housing a different number of nicotine or flavourant containing containers, or by providing an article in which it is possible for a user to insert or remove a nicotine or flavourant containing container, it is possible to provide the user with a choice of duration or intensity of the smoking experience, or a choice of a flavoured or unflavoured smoking experience, or a choice with respect to both.

As used herein, the terms 'upstream', 'downstream' and 'distal' and 'proximal' are used to describe the relative positions of components, or portions of components, of aerosol-generating articles, aerosol-generating devices and aerosol-generating systems according to the invention in relation to the direction of air drawn through the aerosol-generating articles, aerosol-generating devices and aerosol-generating systems during use thereof. It will be understood that the terms 'distal' and 'proximal', when used to describe the relative positions of components of the elongate piercing member, are used such that the piercing head is at the distal, 'free', end and the proximal, 'fixed', end is connected to the device.

As used herein, the term "longitudinal" is used to describe the direction between the downstream end and the opposed upstream end of the aerosol-generating article or aerosol-generating device and the term "transverse" is used to describe the direction perpendicular to the longitudinal direction.

The upstream and downstream ends of the aerosol-generating article are defined with respect to the airflow when a user draws on the downstream or mouth end of the aerosol-generating article. Air is drawn into the aerosol-generating article at the upstream end, passes downstream through the aerosol-generating article and exits the aerosol-generating article at the downstream end.

In those embodiments comprising two or more sealed containers, the containers are preferably arranged in series from an air inlet to an air outlet within the aerosol-generating system. Arranging the container in series advantageously facilitates piercing of the seals on all of the containers with a single elongate piercing member.

As used herein, by "series" it is meant that the containers are arranged within the aerosol-generating article so that in use an air stream drawn through the aerosol-generating article passes through each of the containers in turn. In those embodiments comprising a container housing a volatile delivery enhancing compound source, the delivery enhancing compound vapour is released from the volatile delivery enhancing compound source and nicotine vapour is released from the nicotine source, and both vapours enter the air stream drawn through the aerosol-generating system. The delivery enhancing compound vapour reacts with the nicotine vapour in the gas phase to form an aerosol, which is delivered to a user.

In those embodiments comprising two or more containers, the containers may abut each other. Alternatively, the containers may be spaced apart. The volume of the containers may be the same or the volume of the containers may be different.

When the aerosol-generating article is fully received within the aerosol-generating device, the elongate piercing member preferably comprises at least a first aperture positioned within the at least one container and at least a second aperture positioned downstream of the at least one container and in fluid communication with the at least one air outlet, wherein the at least a first aperture is in fluid communication with the at least a second aperture via the hollow shaft portion. This arrangement allows vapour from within the at least one container to enter the airstream within the hollow shaft portion via the at least a first aperture, and the vapour-containing airstream to exit the hollow shaft portion into the at least one air outlet via the at least a second aperture. In those embodiments comprising two or more containers, the hollow shaft portion preferably comprises at least one aperture positioned within each container and the at least a second aperture downstream of the containers and in fluid communication with the at least one air outlet. To optimise the airflow through the system, the hollow shaft portion preferably comprises at least two apertures positioned within each container. Additionally, or alternatively, the hollow shaft portion preferably comprises at least two apertures downstream of the at least one container and in fluid communication with the at least one air outlet.

The piercing head may also include an aperture in fluid communication with the airflow passage inside the hollow shaft portion, either in addition to at least one aperture in the hollow shaft portion downstream of the at least one container and in fluid communication with the at least one outlet, or as an alternative to such an aperture in the hollow shaft portion. However, preferably the piercing head does not include any apertures, since apertures in the piercing head may become blocked with portions of the seals when the aerosol-generating article is inserted into the aerosol-generating device.

In any of the embodiments described above, each container may comprise a tubular porous element. Preferably, the nicotine, the volatile delivery enhancing compound, the flavourant, or other volatile compound, is sorbed on the tubular porous element.

Preferably, the longitudinal length of the tubular porous element is less than the longitudinal length of the sealed container. The tubular porous element is preferably positioned at the upstream end of the sealed container. When the aerosol-generating article is received in the aerosol-generating device, the at least one aperture in fluid communication with the sealed container is preferably adjacent a downstream portion of the sealed container without the tubular porous element.

As used herein, by "sorbed" it is meant that the nicotine, the volatile delivery enhancing compound, the flavourant, or other volatile compound, is adsorbed on the surface of the tubular porous element, or absorbed in the tubular porous element, or both adsorbed on and absorbed in the tubular porous element.

The internal diameter of the tubular porous element is preferably between about 2 mm and about 5 mm, more preferably between about 2.5 mm and about 3.5 mm. In a preferred embodiment, the internal diameter of the tubular porous element is about 3 mm.

The tubular porous element preferably has a longitudinal length of between about 7.5 mm and about 15 mm, more preferably of between about 9 mm and about 11 mm, and in the preferred embodiment the tubular porous element has a longitudinal length of about 10 mm.

The tubular porous element may be a hollow cylinder. The hollow cylinder is preferably a right circular hollow cylinder. The tubular porous element preferably has a diameter such that when the aerosol-generating article is received in the aerosol-generating device, the hollow shaft portion forms an interference fit within the tubular porous element.

In any of the embodiments described above, the aerosol-generating system may comprise at least one further element. The aerosol-generating system may further comprise one, two, three, four, five or more further elements. The further element may be any of: a filter element; an additional container; an aerosol forming chamber; and a hollow tube. In a preferred embodiment the further element comprises a mouthpiece. The mouthpiece may be sealed at one or both ends before use.

The mouthpiece may comprise any suitable material or combination of materials. Examples of suitable materials include thermoplastics that are suitable for food or pharmaceutical applications, for example polypropylene, polyetheretherketone (PEEK) and polyethylene. The mouthpiece may form part of the aerosol-generating article, part of the aerosol-generating device, or the mouthpiece may be formed separately and configured to attach to at least one of the aerosol-generating article and the aerosol-generating device. In a preferred embodiment, the mouthpiece either forms part of the aerosol-generating article or is attachable to the aerosol-generating article so that the user can use the mouthpiece as a pushing device to insert the aerosol-generating article into the aerosol-generating device. In this way, any risk of the user contacting the elongate piercing member is eliminated. Furthermore, the mouthpiece may function as a pulling device to facilitate removal of the aerosol-generating article from the aerosol-generating device after the smoking experience is complete. The mouthpiece may comprise means for releasably engaging with the aerosol-generating device to maintain the aerosol-generating article in the fully inserted position during the smoking experience.

In those embodiments comprises a mouthpiece, the mouthpiece preferably forms or comprises the at least one air outlet of the aerosol-generating system.

Additionally, or alternatively, the aerosol-generating article and the aerosol-generating device may each comprise a guiding and alignment means that cooperate to ensure the correct orientation and insertion of the aerosol-generating article into the aerosol-generating device. For example, the aerosol-generating article may comprise a housing having an exterior transverse cross-sectional profile that matches a corresponding interior transverse cross-sectional profile of the outer housing of the aerosol-generating device. In this case, the matching profiles are preferably rotationally asymmetric so that the aerosol-generating article can be inserted in the aerosol-generating device in only one orientation, and to prevent rotation of the aerosol-generating article once it has been inserted into the aerosol-generating device.

In a preferred embodiment the outer housing of the aerosol-generating device comprises a cavity configured to receive the aerosol-generating article. Preferably, the cavity has a longitudinal length greater than the longitudinal length of the elongate piercing member. In this way, the piercing portion of the piercing member is not exposed or accessible by the user.

Preferably, the cavity of the aerosol-generating device is substantially cylindrical. The cavity of the aerosol-generating device may have a transverse cross-section of any suitable shape. For example, the cavity may be of substantially circular, elliptical, triangular, square, rhomboidal, trapezoidal, pentagonal, hexagonal or octagonal transverse cross-section.

Preferably, the cavity of the aerosol-generating device has a transverse cross-section of substantially the same shape as the transverse cross-section of the aerosol-generating article to be received in the cavity. As described above, the transverse cross-sectional profiles of the cavity and the aerosol-generating article are preferably rotationally asymmetric to ensure that the aerosol-generating article can only be inserted into the aerosol-generating device in the correct orientation.

The aerosol-generating system may further comprise a power supply, at least one heater, and control circuitry. The control circuitry is preferably configured to control the supply of power to the at least one heater such that the nicotine and any other volatile compound is sufficiently volatilised to enable the generation of an aerosol.

The overall dimensions of the aerosol-generating system may be similar to a conventional smoking article such as a cigarette, a cigar a cigarillo or any other such smoking article.

In use, the user inserts the aerosol-generating article into the outer housing of the aerosol-generating device. As the user inserts the aerosol-generating article, the piercing member pierces the seals on the at least one container. In those embodiments comprising two or more containers, the piercing member pierces the seal at an upstream end of the upstream container, passes through the tubular porous element (where included), and then pierces the seal at the downstream end of the container. The piercing member then pierces the seal at the upstream end of the next container, passes through the container and then pierces the seal at the downstream end of the container. The aerosol-generating article is fully inserted once all of the seals on all of the containers have been pierced by the elongate piercing member. Each seal is formed from a deformable material, as described above.

In those embodiments comprising a volatile delivery enhancing compound source, the term "volatile" us used to mean that the delivery enhancing compound has a vapour pressure of at least about 20 Pa. Unless otherwise stated, all vapour pressures referred to herein are vapour pressures at 25° C. measured in accordance with ASTM E1194-07.

Preferably, the volatile delivery enhancing compound has a vapour pressure of at least about 50 Pa, more preferably at least about 75 Pa, most preferably at least 100 Pa at 25° C.

Preferably, the volatile delivery enhancing compound has a vapour pressure of less than or equal to about 400 Pa, more preferably less than or equal to about 300 Pa, even more preferably less than or equal to about 275 Pa, most preferably less than or equal to about 250 Pa at 25° C.

In certain embodiments, the volatile delivery enhancing compound may have a vapour pressure of between about 20 Pa and about 400 Pa, more preferably between about 20 Pa and about 300 Pa, even more preferably between about 20 Pa and about 275 Pa, most preferably between about 20 Pa and about 250 Pa at 25° C.

In other embodiments, the volatile delivery enhancing compound may have a vapour pressure of between about 50 Pa and about 400 Pa, more preferably between about 50 Pa and about 300 Pa, even more preferably between about 50 Pa and about 275 Pa, most preferably between about 50 Pa and about 250 Pa at 25° C. In further embodiments, the volatile delivery enhancing compound may have a vapour pressure of between about 75 Pa and about 400 Pa, more preferably between about 75 Pa and about 300 Pa, even more preferably between about 75 Pa and about 275 Pa, most preferably between about 75 Pa and about 250 Pa at 25° C.

In yet further embodiments, the volatile delivery enhancing compound may have a vapour pressure of between about 100 Pa and about 400 Pa, more preferably between about 100 Pa and about 300 Pa, even more preferably between about 100 Pa and about 275 Pa, most preferably between about 100 Pa and about 250 Pa at 25° C.

The volatile delivery enhancing compound may comprise a single compound. Alternatively, the volatile delivery enhancing compound may comprise two or more different compounds.

Where the volatile delivery enhancing compound comprises two or more different compounds, the two or more different compounds in combination have a vapour pressure of at least about 20 Pa at 25° C.

Preferably, the volatile delivery enhancing compound is a volatile liquid.

The volatile delivery enhancing compound may comprise a mixture of two or more different liquid compounds.

The volatile delivery enhancing compound may comprise an aqueous solution of one or more compounds. Alternatively the volatile delivery enhancing compound may comprise a non-aqueous solution of one or more compounds.

The volatile delivery enhancing compound may comprise two or more different volatile compounds. For example, the volatile delivery enhancing compound may comprise a mixture of two or more different volatile liquid compounds.

Alternatively, the volatile delivery enhancing compound may comprise one or more non-volatile compounds and one or more volatile compounds. For example, the volatile delivery enhancing compound may comprise a solution of one or more non-volatile compounds in a volatile solvent or a mixture of one or more non-volatile liquid compounds and one or more volatile liquid compounds.

The delivery enhancing compound preferably comprises an acid or ammonium chloride. Preferably, the delivery enhancing compound comprises an acid. More preferably, the delivery enhancing compound comprises an acid having a vapour pressure of at least about 5 Pa at 20° C. Preferably, the acid has a greater vapour pressure than nicotine at 20° C.

The delivery enhancing compound may comprise an organic acid or an inorganic acid. Preferably, the delivery enhancing compound comprises an organic acid. More preferably, the delivery enhancing compound comprises a carboxylic acid. Most preferably, the carboxylic acid comprises a 2-oxo acid.

In a preferred embodiment, the 2-oxo acid comprises an acid selected from the group consisting of 3-methyl-2-oxovaleric acid, pyruvic acid, 2-oxovaleric acid, 4-methyl-2-oxovaleric acid, 3-methyl-2-oxobutanoic acid, 2-oxooctanoic acid and combinations thereof. In a particularly preferred embodiment, the delivery enhancing compound comprises pyruvic acid.

In those embodiments in which the volatile delivery enhancing compound is provided on a tubular porous element, the tubular porous element is preferably a sorption element with an acid or ammonium chloride sorbed thereon.

The tubular porous element may be formed from any suitable material or combination of materials. For example, the sorption element may comprise one or more of glass, stainless steel, aluminium, polyethylene (PE), polypropylene, polyethylene terephthalate (PET), polybutylene terephthalate (PBT), polytetrafluoroethylene (PTFE), expanded polytetrafluoroethylene (ePTFE), and BAREX®.

The tubular porous element may comprise one or more porous materials selected from the group consisting of porous plastic materials, porous polymer fibres and porous glass fibres. The one or more porous materials may or may not be capillary materials and are preferably inert with respect to the acid or ammonium chloride. The particular preferred porous material or materials will depend on the physical properties of the acid or ammonium chloride. The one or more porous materials may have any suitable porosity so as to be used with different acids having different physical properties.

Suitable porous fibrous materials include, but are not limited to: cellulose cotton fibres, cellulose acetate fibres and bonded polyolefin fibres, such as a mixture of polypropylene and polyethylene fibres.

The tubular porous element may have any suitable size and shape.

The size, shape and composition of the tubular porous element may be chosen to allow a desired amount of volatile delivery enhancing compound to be sorbed on the tubular porous element.

The tubular porous element advantageously acts as a reservoir for the delivery enhancing compound.

In any of the embodiments described above, the nicotine source preferably comprises one or more of nicotine, nicotine base, a nicotine salt, or a nicotine derivative.

The source of nicotine may comprise natural nicotine or synthetic nicotine. The source of nicotine may comprise nicotine base, a nicotine salt, such as nicotine-HCl, nicotine-bitartrate, or nicotine-ditartrate, or a combination thereof.

The source of nicotine may further comprise an electrolyte forming compound. The electrolyte forming compound may be selected from the group consisting of alkali metal hydroxides, alkali metal oxides, alkaline earth metal oxides, sodium hydroxide (NaOH), calcium hydroxide ($Ca(OH)_2$), potassium hydroxide (KOH) and combinations thereof.

Alternatively or in addition, the source of nicotine may further comprise other components including, but not limited to, natural flavours, artificial flavours and antioxidants.

Preferably, the nicotine source comprises a liquid nicotine formulation.

The liquid nicotine formulation may comprise pure nicotine, a solution of nicotine in an aqueous or non-aqueous solvent or a liquid tobacco extract.

The liquid nicotine solution may comprise an aqueous solution of nicotine base, a nicotine salt, such as nicotine-HCl, nicotine-bitartrate, or nicotine-ditartrate and an electrolyte forming compound.

The nicotine source may comprise a sorption element and nicotine sorbed on the sorption element. In a preferred embodiment, the nicotine source comprises a volatile liquid nicotine source.

The invention will now be further described, by way of example only, with reference to the accompanying drawing in which FIG. 1 shows a schematic representation of an embodiment of an aerosol-generating system according to the present invention.

FIG. 1 shows a schematic representation of an aerosol-generating system 100. The system 100 comprises an aerosol-generating device 102 and an aerosol-generating article 104. The aerosol-generating article 104 has an elongate cylindrical shape and comprises a first container 106 comprising a volatile delivery enhancing compound source, and a second container 108 comprising a volatile liquid nicotine source. The first container 106 and the second container 108 are arranged in series and abut each other in axial alignment. The first container 106 is positioned at the upstream end of the aerosol-generating article 104. The second container 108 is positioned downstream of the first container 106. A further element (not shown) in the form of a mouthpiece or the like may be provided at the downstream end of the second container 108.

The first container comprises a tubular porous element 109 on which the volatile delivery enhancing compound is sorbed. The longitudinal length of the tubular porous element is less than the longitudinal length of the first container 106. The tubular porous element is positioned at the upstream end of the first container.

The upstream and downstream ends of the first container 106 and the second container 108 of the aerosol-generating article 104 are sealed by deformable seals 110, 112 and 114, 116 respectively. The deformable seals are made from a deformable material, as described above. Suitable materials include polymeric materials, such as a rubber or a plastic.

The aerosol-generating device 102 comprises an outer housing 118 having an elongate cylindrical cavity configured to receive the aerosol-generating article 104. The longitudinal length of the cavity is less than the length of the article 104 such that the downstream end of the article 104 protrudes from the cavity.

The device 102 further comprises an elongate piercing member 120. The piercing member is positioned centrally within the cavity of the aerosol-generating device and extends along the longitudinal axis of the cavity. At one end, the piercing member 120 comprises a piercing head 122 in the form of a cone having a circular base. The piercing member further comprises a hollow shaft portion 124 having a plurality of apertures. As can be seen, when the aerosol-generating article is received within the aerosol-generating device, the apertures are provided in sets, one set 126 being within the first container 106, and three sets 128, 130 and 132 being within the second container 108. Each set, 126, 128, 130 and 132 comprises a plurality of apertures arranged around the circumference of the hollow shaft portion 124. One or more outlet apertures 134 are provided in the downstream end of the elongate piercing member, wherein the one or more outlet apertures 134 are positioned downstream of the second container 108.

Air inlets (not shown) are provided at the upstream end of the aerosol-generating device 102. Air outlets (not shown) are provided at the downstream end of the aerosol-generating article 104. The air inlets are in fluid communication with an upstream end of the airflow passage within the hollow shaft portion 124. The air outlets are in fluid communication with the one or more outlet apertures 134 in the downstream end of the elongate piercing member.

In use, the article 104 is inserted into the device 102. The piercing head 122 breaks the deformable seal 110 and creates a hole in the seal having a diameter approximately equal to the maximum diameter of the piercing head. The maximum diameter of the piercing head is the diameter of the base circle of the cone which forms the piercing head, and is substantially equal to the maximum diameter of the hollow shaft portion. As can be seen the internal diameter of the device cavity relative to the external diameter of the article 104 is such that the article is located centrally within the cavity.

The piercing head then engages with the second deformable seal of the first container 106. Again, the piercing head breaks the deformable seal 112 and creates a hole in the seal having a diameter approximately equal to the maximum diameter of the piercing head. As can be seen, the maximum diameter of the piercing head is approximately equal to the internal diameter of the tubular porous element 109. At this stage, the piercing head also breaks through the first deformable seal 114 of the second container 108, and creates a hole in the seal having a diameter approximately equal to the maximum diameter of the piercing head.

The piercing head then engages with the second deformable seal of the second container. Again, the piercing head breaks the frangible seal 116 and creates a hole in the seal having a diameter approximately equal to the maximum diameter of the piercing head.

Each time the piercing head 122 engages with a deformable seal, the deformable material is deformed as the hole is created in the seal. Therefore, once the hole is formed and the piercing member 120 is pushed through the hole, the deformable material contracts and maintains the seal around the outside of the hollow shaft portion 124.

In use, when the aerosol-generating article 104 is fully inserted into the aerosol-generating device 102, an air flow pathway, shown by the solid arrows, is formed through the aerosol-generating system. The air flow pathway extends from the upstream end of the aerosol-generating article 104 through the air inlets to the downstream end of the article 104. The volatile delivery enhancing compound is entrained into the air flow, through the apertures 126, because of the reduction in air pressure within the hollow shaft portion when the user draws on the downstream end of the aerosol-generating article. The air then continues through the hollow shaft portion and entrains the volatile liquid nicotine vapour released from the volatile liquid nicotine source. The nicotine vapour is also entrained into the air flow, through the apertures 128, 130 and 132, because of the reduction in air pressure within the hollow shaft portion when the user draws on the downstream end of the aerosol-generating article. Due to the sealing effect of deformable material forming the seals 110, 112, 114 and 116 around the outside of the hollow shaft portion 124, airflow around the outside of the hollow shaft portion 124 is reduced or eliminated. This ensures maximum delivery of the aerosol particles to the user.

Delivery enhancing compound vapour, which in the preferred embodiment contains pyruvic acid, is released from the delivery enhancing compound sorbed on the tubular porous element 109 into the air stream drawn through the aerosol-generating article 104 and nicotine vapour is released from the volatile liquid nicotine source in the second container 108 into the air stream drawn through the aerosol-generating article 104. The delivery enhancing compound vapour reacts with the nicotine vapour in the gas phase to form an aerosol, which is delivered to the user through the downstream end of the aerosol-generating article 104.

The invention has been exemplified above by reference to aerosol-generating systems comprising aerosol-generating devices comprising a piercing member having a conical piercing head. However, it will be appreciated that aerosol-generating systems and aerosol-generating devices according to the invention may comprise other forms of piercing head.

The invention claimed is:

1. An aerosol-generating system, comprising:

an aerosol-generating device in cooperation with an aerosol-generating article, the aerosol-generating article comprising:

at least one container housing a nicotine source, and at least two seals sealing the at least one container, wherein each seal comprises a deformable material; and the aerosol-generating device comprising:

an outer housing configured to receive the aerosol-generating article, and an elongate piercing member configured to pierce the at least two seals, the elongate piercing member comprising:

a piercing head disposed at a distal end of the elongate piercing member, and a hollow shaft portion comprising at least two apertures, wherein, when the aerosol-generating article is received in the aerosol-generating device, at least one aperture of the at least two apertures is in fluid communication with the at least one container.

2. The aerosol-generating system according to claim 1, wherein the deformable material has a Young's modulus of less than 10 GPa when measured in accordance with ASTM E111-04.

3. The aerosol-generating system according to claim 1, wherein the deformable material has a Young's modulus of at least 0.01 GPa when measured in accordance with ASTM E111-04.

4. The aerosol-generating system according to claim 1, wherein the deformable material forming each seal comprises a polymeric material.

5. The aerosol-generating system according to claim 1, wherein a maximum diameter of the piercing head is less than or equal to a maximum diameter of the hollow shaft portion.

6. The aerosol-generating system according to claim 1, wherein the hollow shaft portion comprises a braided tube.

7. The aerosol-generating system according to claim 1, wherein the aerosol-generating system further comprises at least one air inlet and at least one air outlet, wherein, when the aerosol-generating article is received in the aerosol-generating device, the at least one air inlet is upstream of the at least one container and the at least one air outlet is downstream of the at least one container, and wherein the at least one air inlet and the at least one air outlet are arranged to define an air flow pathway extending from the at least one air inlet to the at least one air outlet via the hollow shaft portion through the at least one container.

8. The aerosol-generating system according to claim 7, wherein, when the aerosol-generating article is received in the aerosol-generating device, the at least two apertures comprise at least a first aperture positioned within the at least one container and at least a second aperture positioned downstream of the at least one container and in fluid communication with the at least one air outlet, and wherein the at least a first aperture is in fluid communication with the at least a second aperture via the hollow shaft portion.

9. The aerosol-generating system according to claim 1, wherein the nicotine source comprises a liquid comprising nicotine.

10. The aerosol-generating system according to claim 1, wherein the at least one container comprises a first container housing the nicotine source and a second container housing a volatile delivery enhancing compound source, and wherein the at least two seals comprise first and second seals sealing the first container and third and fourth seals sealing the second container.

11. The aerosol-generating system according to claim 10, wherein the aerosol-generating system further comprises at least one air inlet and at least one air outlet, wherein, when the aerosol-generating article is received in the aerosol-generating device, the at least one air inlet is upstream of the first and second containers and the at least one air outlet is downstream of the first and second containers, and wherein the at least one air inlet and the at least one air outlet are arranged to define an air flow pathway extending from the at least one air inlet to the at least one air outlet via the hollow shaft portion through the first and second containers.

12. The aerosol-generating system according to claim 11, wherein, when the aerosol-generating article is received in the aerosol-generating device, the at least two apertures comprise at least a first aperture positioned within the first container, at least a second aperture positioned within the second container, and at least a third aperture positioned downstream of the first and second containers and in fluid communication with the at least one air outlet, and wherein the at least the first aperture, the at least the second aperture, and the at least the third aperture are in fluid communication via the hollow shaft portion.

13. The aerosol-generating system according to claim 10, wherein the volatile delivery enhancing compound comprises an acid.

14. The aerosol-generating system according to claim 1, wherein the at least one container comprises a first container housing a nicotine source and a second container housing at least one of a nicotine source and a flavourant source, and wherein the second container is configured to be inserted into the aerosol-generating article or to be removed from the aerosol-generating article by a user before the aerosol-generating article is inserted into the aerosol-generating device, so that the aerosol-generating article is insertable into the aerosol-generating device with or without the second container.

15. The aerosol-generating system according to claim 1, further comprising a mouthpiece connected to the aerosol-generating article, wherein the mouthpiece releasably engages a downstream end of the aerosol-generating device outer housing when the aerosol-generating article is inserted into the aerosol-generating device.

* * * * *